US005207307A

United States Patent [19]

Waite

[11] Patent Number: 5,207,307

[45] Date of Patent: May 4, 1993

[54] COIN TESTING APPARATUS

[75] Inventor: Timothy P. Waite, Esher, England

[73] Assignee: Mars Incorporated, McLean, Va.

[21] Appl. No.: 778,978

[22] PCT Filed: Jun. 21, 1990

[86] PCT No.: PCT/GB90/00956

§ 371 Date: Jan. 6, 1992

§ 102(e) Date: Jan. 6, 1992

[87] PCT Pub. No.: WO91/01029

PCT Pub. Date: Jan. 24, 1991

[30] Foreign Application Priority Data

Jul. 7, 1989 [GB] United Kingdom ..... 8915640

[51] Int. Cl.[5] ..... G07D 5/08

[52] U.S. Cl. ..... 194/317

[58] Field of Search ..... 194/317, 318, 319; 29/606

[56] References Cited

U.S. PATENT DOCUMENTS 3,870,137 3/1975 Fougere ..... 194/317

FOREIGN PATENT DOCUMENTS 2542295 3/1977 Fed. Rep. of Germany .

*Primary Examiner*—F. J. Bartuska

*Attorney, Agent, or Firm*—Davis Hoxie Faithfull & Hapgood

[57] ABSTRACT

In a coin testing apparatus, the front face of an inductive coil, the front fact of a high-permeability core for the coil, and a structural part of the apparatus, are all accurately located relative to each other by having the coil wound on a former having a front flange which determines the relative positioning of those features.

2 Claims, 1 Drawing Sheet

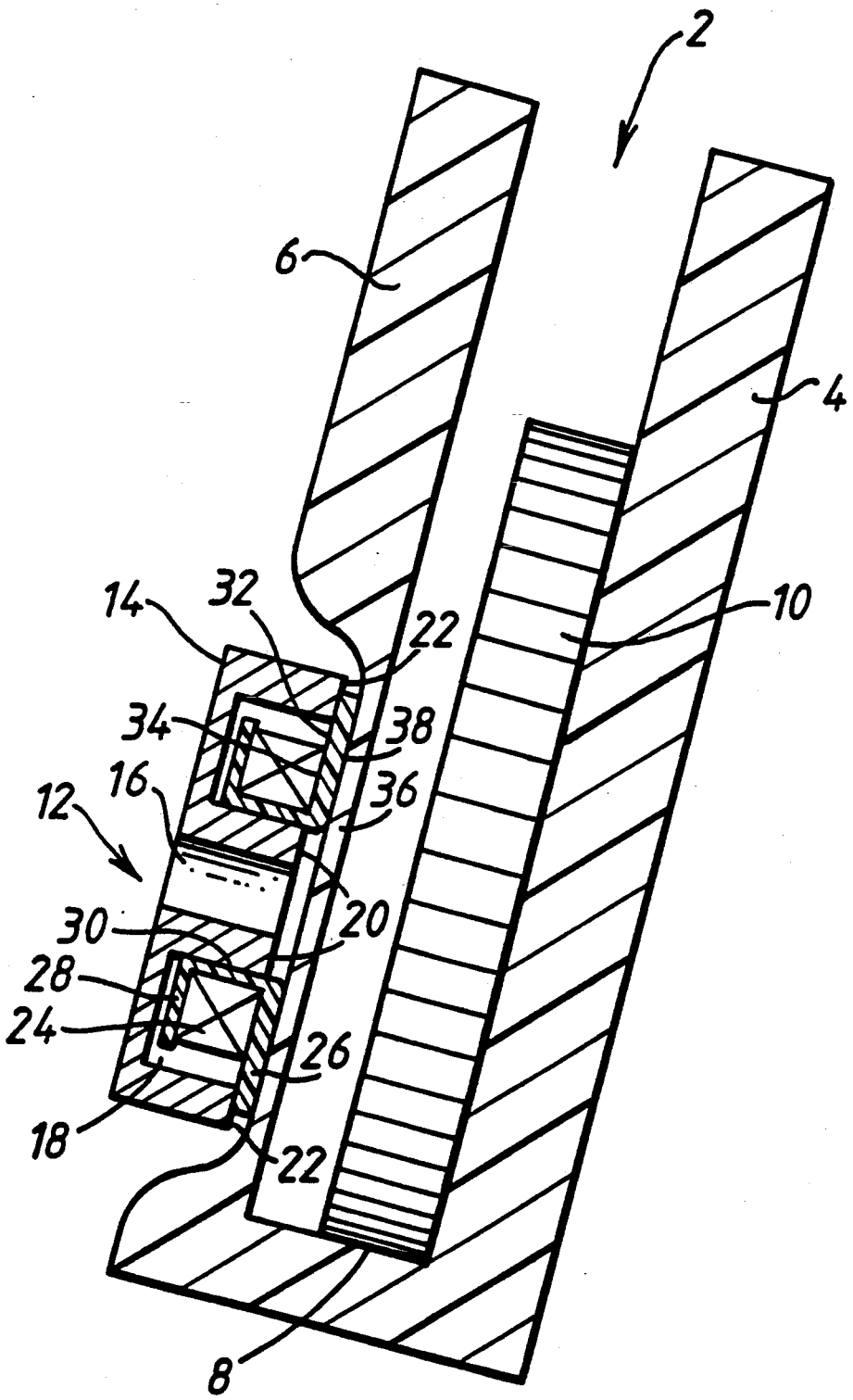
2
6
4
14
32
22
10
34
38
16
36
12
20
30
28
24
26
18
22
8

COIN TESTING APPARATUS

FIELD OF THE INVENTION

This invention relates to coin testing apparatus of the kind comprising at least one magnetic inductor for generating or detecting an oscillating magnetic field with which a coin to be tested interacts.

BACKGROUND OF THE INVENTION

Many kinds of such apparatus are widely available commercially, and normally they use several such inductors for producing (and in some instances receiving) a plurality of magnetic fields which interact with the coins to be tested in different ways. The present invention concerns the structure of such inductors and their positioning within the apparatus, and reference is made to GB-A-1 452 740 and GB-A-2 094 008, for example, for further information as to how other aspects of such apparatus may be arranged and operated.

It is desirable, ideally, that the inductors having a particular function in each of the coin testing apparatuses manufactured to a given design should have identical operating characteristics. This is not achieved in practice due to tolerance variations in the actual construction of the inductors and in their assembly into the apparatuses.

Typically, an inductor comprises a core, frequently annular in shape, of high magnetic permeability material having a recess in its front face, the recess also being annular in the case of an annular core, and an inductive coil located in the recess.

U.S. Pat. No. 3,870,137 discloses (see its FIG. 6) such an inductor, in which the coil is on a former. The Applicants have regularly used such a design for many years, but there have been variations between the operating characteristics of different inductors. It has been found that this partly arises from the fact that, in assembling that type of inductor, it is usual for the former to be pressed or to fall until it contacts the bottom of the recess. Consequently any variations (as between one inductor and another) in the depth of the recess, or in the front-to-back dimension of the former, will result in related variations in the position of the front face of the coin relative to the front face of the core, and relative to the coin passageway side wall when the core is positioned against the side wall. These variations could affect the uniformity of performance between different inductors.

SUMMARY OF THE INVENTION

For the purposes of the present specification including the claims, the term "front face" will be used in respect of that face of the core which in operation faces towards a coin being tested, and also in respect of that face of the coil which faces towards the coin.

The invention involves positioning the front face of the coil in predetermined relationship to the front face of the core. The invention also involves positioning the front face of the coil in predetermined relationship to a structural part of the apparatus adjacent to a passageway along which coins to be tested pass, and hence in predetermined relationship to the passageway and also, ideally, to coins which pass along the passageway.

We have found that these are important factors in helping to achieve uniformity of operating characteristics as between all inductors made to a given design.

More specifically, the invention provides coin testing apparatus of the kind comprising at least one magnetic inductor for generating or detecting an oscillating magnetic field with which a coin to be tested interacts, wherein said inductor comprises a core of high magnetic permeability material having a recess in its front face for receiving an inductive coil, and an inductive coil which is carried on a former, has a front face, and is located within the recess, the inductor being mounted such that the front faces of the core and the coil face a structural part of the passageway along which coins to be tested pass, characterised in that the former is provided with radially extending abutment means fixedly located relative to the coil and extending between, and contacting both of, the front face of the core and said structural part, so as to determine the position of the front face of the coil relative to the front face of the core and relative to said structural part.

BRIEF DESCRIPTION OF THE DRAWING

In order that the invention may be more clearly understood, an embodiment thereof will now be described, by way of example, with reference to the accompanying diagrammatic drawing, which is a cross-section through the coin passageway of a coin testing apparatus and an associated inductor.

DETAILED DESCRIPTION

As is common in the art, a coin passageway 2 is defined by side walls 4 and 6 at the bottom of which is a coin track 8 on which coins, such as coin 10, roll in a direction perpendicular to the drawing past one or more inductors such as the inductor 12 shown. The passageway is inclined to the vertical so as to ensure in so far as possible that the coins always roll past the sensors in contact with wall 4, this being for the purpose of reducing variable factors that would hinder accurate and repeatable testing of the coins.

The inductor 12 comprises an annular core 14 of high magnetic permeability material such as ferrite, having a central hole 16. The front of the core 14, directed towards coin 10, has an annular recess 18 extending deeply into it, leaving a front face consisting of annular inner and outer portions 20 and 22 respectively.

An annular coil 24 is wound on a former or bobbin having front and rear radially outwardly projecting flanges 26 and 28 joined by a central cylindrical part 30, and the coil fills the space, in the axial direction, between flanges 26 and 28.

In assembling the inductor, the former with the coil 24 on it is inserted into the recess 18 until the margin of the rear surface 32 of flange 26 contacts portion 22 of the front face of the core. Since in this condition the position of the front face 34 of the coil 24 relative to the front face 22, 20 of the core 14 is being determined by the necessarily relatively small axial distance between surface 32 and the front face of the coil, and the related part of the former (26, 28, 30) can readily be manufactured (e.g. by injection moulding in plastics) to very small tolerances, the relative positioning of coil and core front faces 34 and 20, 22 can be made constant to within very small tolerances throughout a large number of such inductors.

The complete inductor is secured to the rear of a thin part 36 of wall 6 by bringing the front surface 38 of flange 26 into contact with the rear of wall part 36 with a very thin layer of (e.g. isocyanate) adhesive between them. For protection and more secure fixing, the entire inductor may then be encapsulated by a body of resin (not shown) applied over its rear side.

The wall 6, and particularly its thin portion 36, can be injection moulded from plastics material, as is usual, to very small tolerances in thickness, and so can the flange 26 of the former. Consequently, since the distance between the front 34 of the coil and the inner surface of passageway wall 6 is simply the sum of these two thicknesses, that distance can also be made constant to within very small tolerances throughout a large number of apparatuses. That helps to ensure that the variation (between one apparatus and another) in the relative positions of the coil front face 34 and the nearest face of the coin to be tested is influenced as little as possible by dimensional factors other than the thickness of the coin itself, and this is important for reliable and repeatable results in the testing of coins.

I claim:

1. Coin testing apparatus comprising at least one magnetic inductor for generating or detecting an oscillating magnetic field with which a coin to be tested interacts, wherein said inductor comprises a core of high magnetic permeability material having a recess in its front face for receiving an inductive coil, and an inductive coil which is carried on a former, has a front face, and is located within the recess, the inductor being mounted such that the front faces of the core and the coil face a structural part of the passageway along which coins to be tested pass, wherein the former is provided with radially extending abutment means fixedly located relative to the coil and extending between, and contacting both of, the front face of the core and said structural part, so as to determine the position of the front face of the coil relative to the front face of the core and relative to said structural part.

2. Coin testing apparatus as claimed in claim 1 wherein said abutment means is a radially outwardly projecting flange of the former.

* * * * *